US010694901B2

(12) United States Patent
Babikian et al.

(10) Patent No.: US 10,694,901 B2
(45) Date of Patent: Jun. 30, 2020

(54) ROLL SHEET MATERIAL DISPENSER

(71) Applicant: BOBRICK WASHROOM EQUIPMENT, INC., North Hollywood, CA (US)

(72) Inventors: Dikran Babikian, Glendale, CA (US); William Conway, Moorpark, CA (US); Marlon Rincan, Arleta, CA (US); Nancy LaCroix-Toyne, Tujunga, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 166 days.

(21) Appl. No.: 15/895,967

(22) Filed: Feb. 13, 2018

(65) Prior Publication Data

US 2018/0263434 A1 Sep. 20, 2018

Related U.S. Application Data

(60) Provisional application No. 62/460,693, filed on Feb. 17, 2017.

(51) Int. Cl.
*A47K 10/38* (2006.01)
*B65H 16/00* (2006.01)
(Continued)

(52) U.S. Cl.
CPC ..... *A47K 10/38* (2013.01); *B65H 16/005* (2013.01); *B65H 16/021* (2013.01);
(Continued)

(58) Field of Classification Search
CPC ..... A47K 10/38; A47K 2010/3206; A47K 2010/3253; B65H 16/005; B65H 16/021;
(Continued)

(56) References Cited

U.S. PATENT DOCUMENTS 2,767,930 A * 10/1956 McCants ..... A47K 10/38 242/560.3
3,058,682 A 10/1962 Mott et al.
(Continued)

OTHER PUBLICATIONS

International Search Report and Written Opinion issued in corresponding International Application No. PCT/US2018/018067, dated Apr. 17, 2018, 12 pages.
(Continued)

*Primary Examiner* — William A. Rivera
(74) *Attorney, Agent, or Firm* — Lewis Roca Rothgerber Christie LLP

(57) ABSTRACT

A method of dispensing sheet material from two rolls includes dispensing a first sheet of material from a first roll of the material located at a first location, lowering the first roll from the first location as the first sheet of material is being dispensed, lowering a second roll of material onto a second location above the first location when the first roll has been lowered to a location below the first location, and dispensing a second sheet of material from the second roll. A dispenser allowing for dispensing from two rolls includes a first wall having a forward end, a second wall opposite and spaced apart from the first wall and a cam coupled to each wall.

19 Claims, 8 Drawing Sheets

(51) Int. Cl.
*B65H 16/02* (2006.01)
*A47K 10/32* (2006.01)

(52) U.S. Cl.
CPC .. *A47K 2010/3253* (2013.01); *B65H 2405/40* (2013.01); *B65H 2701/1924* (2013.01)

(58) Field of Classification Search
CPC .... B65H 75/08; B65H 75/22; B65H 2405/40; B65H 270/1924; B65H 2701/1846
See application file for complete search history.

(56) References Cited

U.S. PATENT DOCUMENTS 3,700,181 A * 10/1972 Diring ..... A47K 10/38 242/560.3
3,771,739 A * 11/1973 Nelson ..... A47K 10/38 242/560.3
4,340,195 A * 7/1982 DeLuca ..... A47K 10/3687 226/110
4,522,346 A * 6/1985 Jespersen ..... A47K 10/40 242/560.3
4,844,361 A * 7/1989 Granger ..... A47K 10/3687 225/93
4,944,466 A * 7/1990 Jespersen ..... A47K 10/3687 242/560.3
5,271,574 A * 12/1993 Formon ..... A47K 10/36 242/560.3
5,558,302 A * 9/1996 Jesperson ..... A47K 10/3687 242/560
5,669,576 A * 9/1997 Moody ..... A47K 10/38 242/560.3
7,878,444 B2 * 2/2011 Friesen ..... A47K 10/3687 242/559.4
9,635,986 B2 5/2017 Phelps
2003/0080237 A1 5/2003 Taylor et al.
2007/0221777 A1 * 9/2007 Valot ..... A47K 10/36 242/560
2009/0266929 A1 * 10/2009 Friesen ..... A47K 10/3687 242/560
2011/0042503 A1 * 2/2011 Hagleitner ..... A47K 10/3687 242/560
2012/0111987 A1 * 5/2012 Phelps ..... A47K 10/40 242/560
2017/0112335 A1 4/2017 Diamond
2017/0112336 A1 4/2017 Ruthven et al.
2017/0290471 A1 10/2017 Borke et al.
2017/0290472 A1 10/2017 Borke et al.
2018/0263433 A1 9/2018 Osbourne, Jr.

OTHER PUBLICATIONS

Georgia-Pacific, Model No. 56782, "Compact", Photo of Double Roll Toilet Tissue Dispenser, 1 page.
Franke, Model No. STRX672, Photo of Double Roll Toilet Tissue Dispenser, 1 page.
Bobrick, Model No. B-2888, "Classic Series", Photo of Double Roll Toilet Tissue Dispenser, 1 page.
SCA/TORK, Model No. 555620, Photo of Double Roll Toilet Tissue Dispenser, 1 page.
Bradley, Model No. 5A10, "Diplomat", Photo of Double Roll Toilet Tissue Dispenser, 1 page.
Kimberly-Clark, Model No. 09021, Photo of Double Roll Toilet Tissue Dispenser, 1 page.
Asi, Model No. 20030, "Royal", Photo of Double Roll Toilet Tissue Dispenser, 1 page.
Tork, Model No. 47 30 20, "Spindle Kit for Tork Coreless High Capacity Bath Tissue Rolls, for Drop Down Dispensers Type B", Photo of Careless Spindle Kit, 2 pages.

* cited by examiner

ROLL SHEET MATERIAL DISPENSER

CROSS-REFERENCE TO RELATED APPLICATION

This application claims priority to and the benefit of U.S. Provisional Patent Application No. 62/460,693 filed Feb. 17, 2017, the entire content of which is incorporated herein by reference.

BACKGROUND OF THE INVENTION

Dispensers for storing and dispensing multiple rolls of sheet material are known. However they often get stuck during operation and an operator has to move a second roll to be dispensed once a first roll is used. Thus, a better dispensing system is desired.

SUMMARY

A method of dispensing sheet material from two rolls includes dispensing a first sheet of material from a first roll of the material located at a first location, lowering the first roll from the first location as the first sheet of material is being dispensed lowering a second roll of material onto a second location above the first location when the first roll has been lowered to a location below the first location, and dispensing a second sheet of material from the second roll. In an example embodiment, the first roll is mounted on a first spindle and the second roll is mounted on a second spindle, and lowering the first roll includes lowering the first spindle. In another example, when at the first location, the first spindle is at a first spindle location, and when at a second location, the second spindle is at a second spindle location, the method further includes maintaining the second spindle at the second spindle location during dispensing of the second sheet of material. In yet another example, prior to lowering the second roll of material onto the second location, the method further includes placing the second roll of material at a third location above the second location. In another example embodiment, prior to lowering the second roll of material onto the second location, the method further includes placing the second roll of material at a third location above the second location. In yet another example embodiment, the method further includes removing the first spindle, and lowering the second spindle to a location below the second spindle location. In yet another example embodiment, the method further includes placing a third roll of sheet material at the third location.

In a further example embodiment a dispenser includes a first wall having a forward end, a second wall opposite and spaced apart from the first wall, the second wall having a forward end. Each of the first and second walls include a vertically extendingly extending slot, a first slot extending transversely from the vertically extendingly extending slot to the forward end, a second slot extending transversely from the vertically extendingly extending slot to the forward end, and the second slot is below the first slot. The dispenser also includes a pivotably coupled cam for pivoting along a plane parallel to its corresponding wall including a first end and a projection below the cam first end. The cam pivots from a first position where the first end and the projection intersect the vertically extendingly extending slot to a second position where the first end does not intersect the vertically extendingly extending slot and the projection intersects the vertically extendingly extending slot. In another example embodiment, the dispenser further includes at least a spindle coupled to the first and second walls proximate a lower end of the walls. In yet a further example embodiment, the dispenser also includes at least a spindle in at least one of the slots on both the first and second walls. In one example embodiment, the spindle includes an inner member and a sleeve coaxially over the inner member and rotatable relative to the inner member. In yet another example embodiment, the inner member includes opposite grooves proximate either end thereof, and the edges of the slots are received in each of the grooves. In any example embodiment, a spindle of the at least a spindle may penetrate a paper material roll. In one embodiment, the paper material roll is a toilet paper tissue roll. In any embodiment, the roll of material may include or may not include a core. In another example embodiment, a third wall interconnects the first and second walls.

DESCRIPTION

Figure 1:
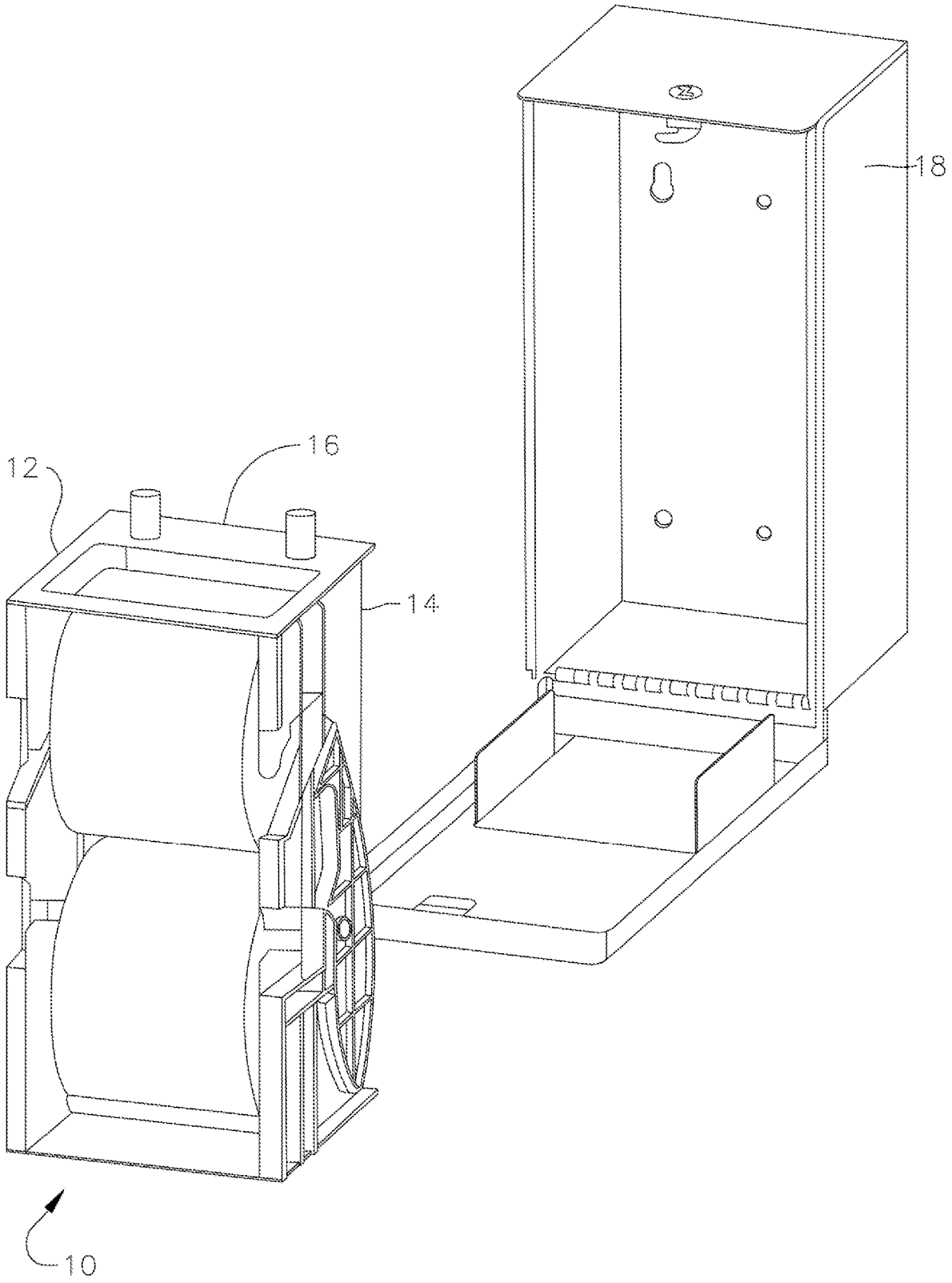
FIG. 1 is an assembly view of a roll sheet material dispenser according to an example embodiment.

In an example embodiment, a toilet tissue dispenser 10 includes a first wall 12 opposite a second wall 14, as for example shown in FIG. 1. While example embodiment dispensers may be used to dispense various types of roll sheet material, example embodiment dispensers are described herein for illustrative purposes as dispensers for dispensing toilet paper tissue. However, in other example embodiments, the dispensers may be used for dispensing other types of roll sheet material, as for example paper towels. The two walls may be interconnected at a rear portion thereof by a rear wall 16. For descriptive purposes, the first wall will be referred to as the left wall 12 and the second wall will be referred to as the right wall 14 and an interconnecting wall will be referred to as the rear wall. Of course it should be understood that the terms "left," "right," "rear," "front," "upper," and "lower" are all relative terms and are not meant to denote the exact position of objects, but rather the relative position of objects. For example, an upper object may be lower than a lower object if the device is turned upside down.

In the shown example embodiment, the dispenser 10 is an insert that is fitted into a housing 18. The housing may be fixed, or otherwise attached to a wall. In other example embodiments, the dispenser is fixed or is integrally formed with the housing.

Figure 2:
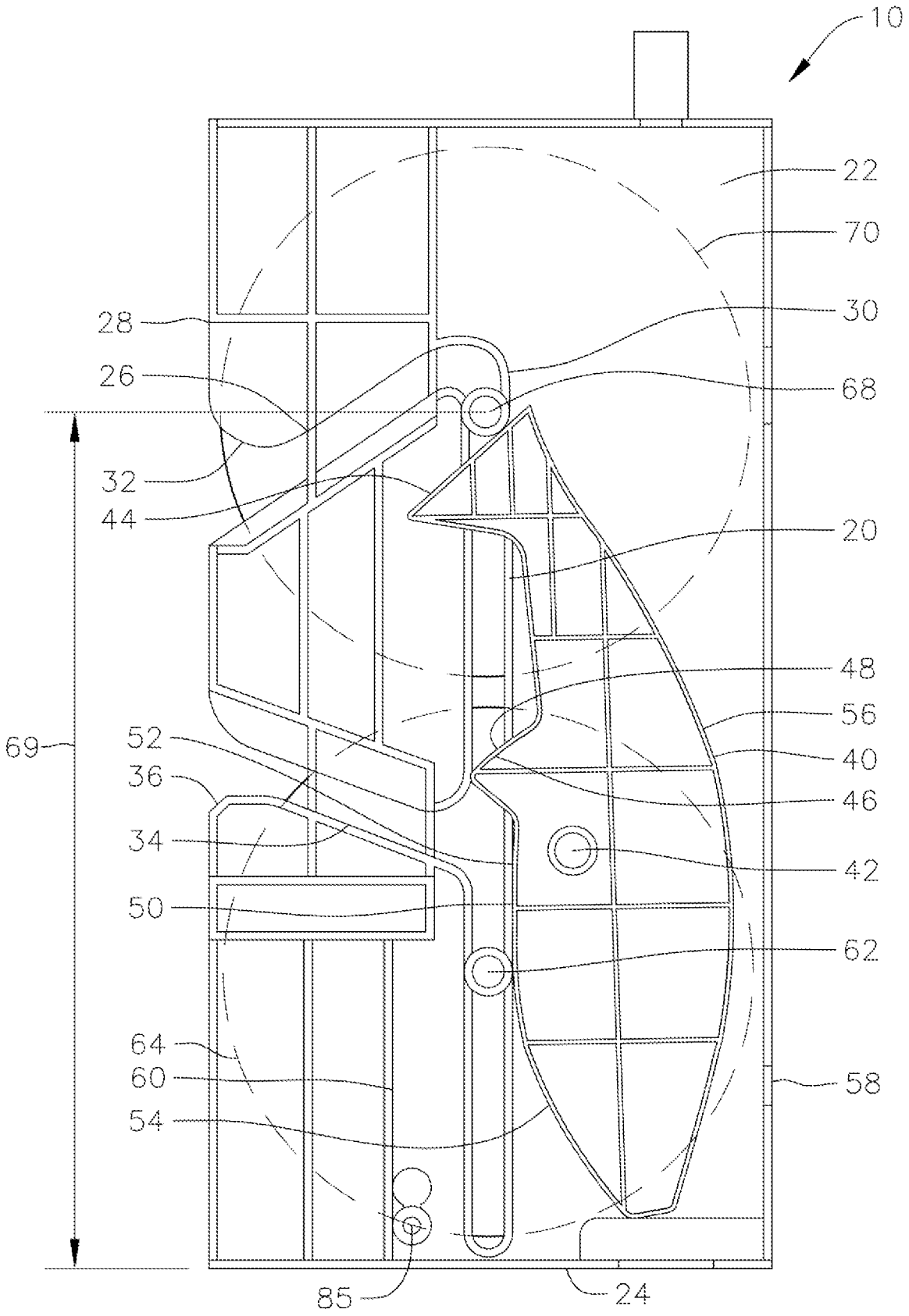
FIG. 2 is a side view of an example embodiment dispenser with two rolls mounted thereon.

In the shown example embodiment, the left and right walls are mirror images of each other. Thus, only the right wall 14 is described herein. In an example embodiment, the right wall includes a vertically extendingly extending slot 20, as for example shown in FIG. 2. In one example embodiment, as shown in FIG. 2, the vertically extending slot is a vertical slot. The vertically extending slot extends from an upper portion 22 of the right wall to proximate a lower end 24 of the right wall. The vertically extending slot is located at mid-width or proximate mid-width of the wall. An upper transverse slot 26 extends from a front end 28 of the right wall and interconnects with the vertically extending slot 20. In an example embodiment, the upper transverse slot 26 is slanted from an upper end 30 of the vertically extending slot towards the front end 28 of the right wall such that the upper transverse slot extends from a higher height at the vertically extending slot to a lower height at the front end of the wall. At the front end of the wall, the upper transverse slot may be widened to form a mouth 32. A lower transverse slot 34 extends below the upper transverse slot and extends from the vertically extending slot 20 to the front end 28 of the right wall. In an example embodiment, the lower transverse slot intersects the vertically extending slot a location below a mid-height of the vertical wall. In an example embodiment, the lower transverse slot is inclined upwards extending from the vertically extending slot upward in a direction toward the front end of the right wall. In an example embodiment, the slot may be widened at the front end of the wall defining a mouth 36.

In an example embodiment, a cam 40 is pivotally coupled to each of the left and right walls. The cam 40 coupled to the right wall is a mirror image or identical to the cam coupled to the left wall. Thus, only the cam pivotably coupled to the right wall is described herein. The cam is pivotally coupled to the right wall at a pivot location (or pivot point) 42 behind the vertically extending slot 20. In an example embodiment, the cam is pivotally coupled to the right wall at a height at proximate the height of where the lower transverse slot 34 intersects the vertically extending slot 20.

Figure 4:
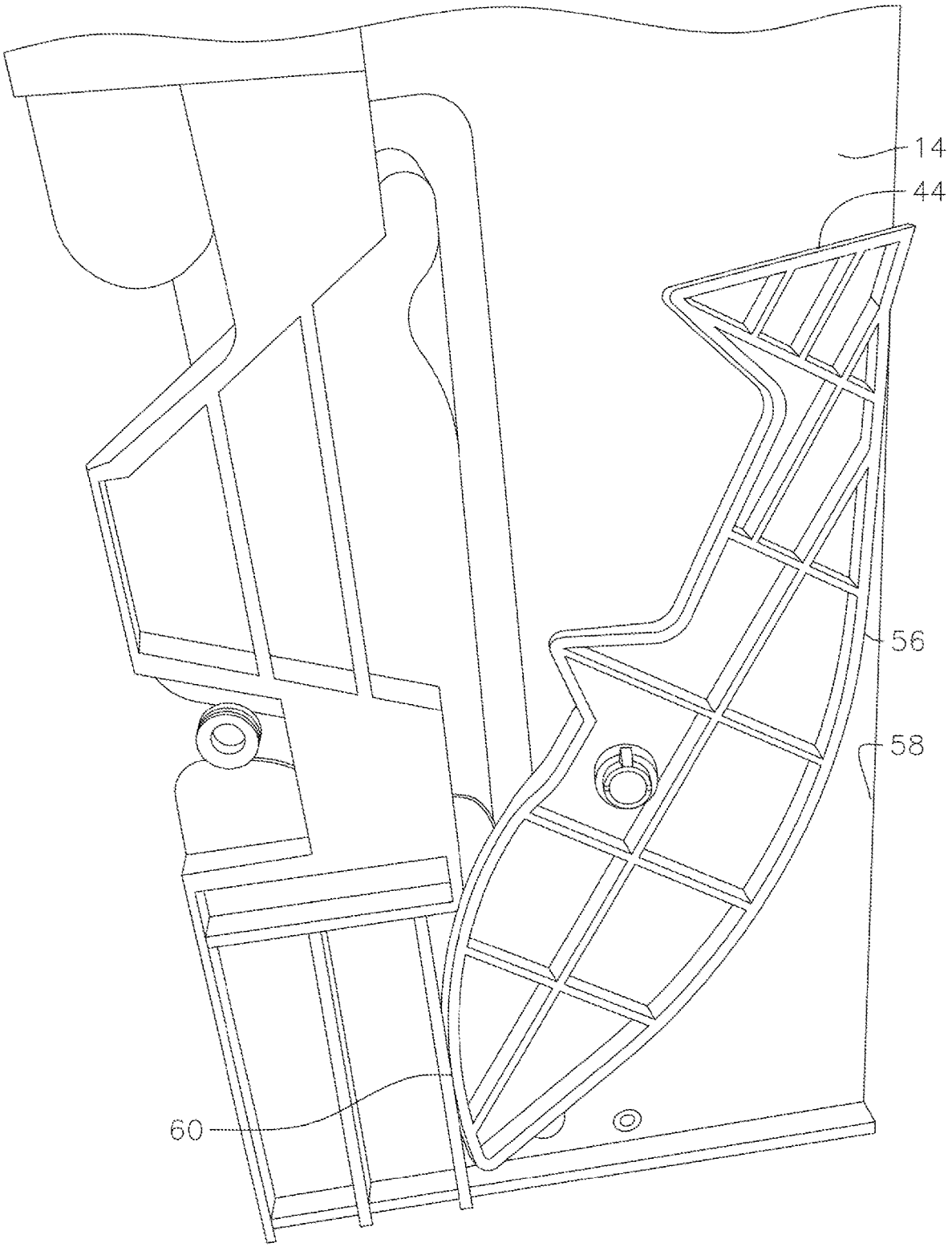
FIG. 4 is a side view of the example embodiment dispenser shown in FIG. 2, in an unloaded position.

The cam has an inclined upper end 44. When pivoted to the right wall, the inclined upper end 44 extends to a height below the maximum height of the upper end 30 of the vertically extending slot. A projection 46 extends below the upper end 44 and defines an intermediate projected end surface 48 and extends in a direction towards the front end 28 of the right wall when the cam is pivotally mounted to the vertical wall. The intermediate projected end surface 48 extends above the location of where the lower transverse slot intersects the vertically extending slot when the cam is pivoted such that the intermediate projected end surface 48 is over the vertically extending slot, it also extends above the pivot point 42 of the cam relative to the vertical wall. In the shown example embodiment, when the cam is pivoted such that its portion above the pivot location is pivoted in a forward-most position, the intermediate projected end surface 48 is inclined downward in a direction toward the front end of the right wall. When in this pivoted position, a front end 50 of the cam below the projection 46 extends vertically downwards along a first portion 52 and then curves in a direction towards the rear of the cam along a second portion 54. A rear end 56 of the cam is curved such that as the cam rotates in the opposite direction (clockwise in FIG. 4), it does not extend further behind a rear end 58 of the right wall 14. Rotation of the cam in this direction may be limited by a stop surface 60 defined on the right wall, as for example shown in FIG. 4. When the second portion 54 of the front end of the cam engages the stop surface 60 rotation of the cam (in a clockwise direction in FIG. 4) is stopped. When pivoted clockwise relative to the right vertical wall and when the cam is uninterrupted, the cam rotates to such a position as shown in FIG. 4, where both the inclined upper 44 end and the intermediate projected end surface 48 move sufficiently away from the vertically extending slot in a rearward direction to allow a spindle to slide along said vertically extending slot.

Figure 5:
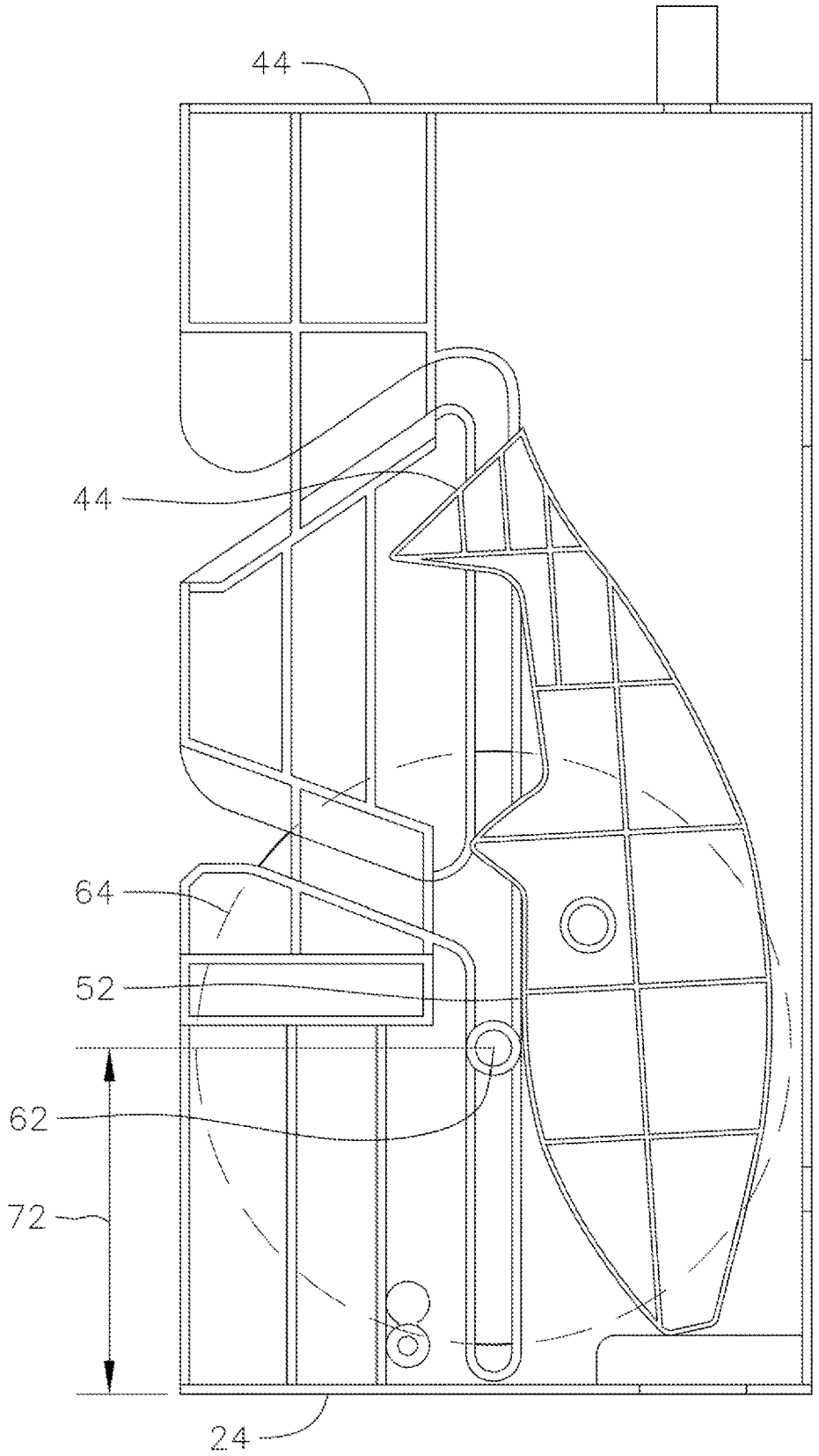
FIG. 5 is a side view of the example embodiment dispenser shown in FIG. 2 with an upper roll moved into a lower dispensing position.

A first spindle 62 is fitted through a first toilet paper roll 64 whether the roll has a core or does not have a core. A core is a tubular member that supports the rolled paper. The first spindle has opposite ends that are slid into the lower transverse slots of the left and right wall and along their corresponding vertically extending slots into a first dispensing position 72 as shown in FIG. 5. A second spindle 68 is fitted through a second toilet paper roll 70 whether the roll has a core or does not have a core. The second spindle has opposite ends that are slid into the upper transverse slots of the left and right wall and along the corresponding vertically extending slots and rest on the upper ends 44 of the cams and into a reserve position 69 as shown in FIG. 2. When in this reserve position, the two toilet paper rolls are spaced apart. When the first toilet paper roll is full of paper, the first spindle will be at a distance 72 from the bottom end 24 of the right wall. As such, the first spindle would be pressing on the front end first portion 52 of the cam 40 causing the cam to rotate (counter-clockwise in FIG. 5) and the inclined upper end 44 of the cam as well as the projection 46 of the cam to move into position over the vertically extending slot 20, as shown in FIG. 5.

Figure 3:
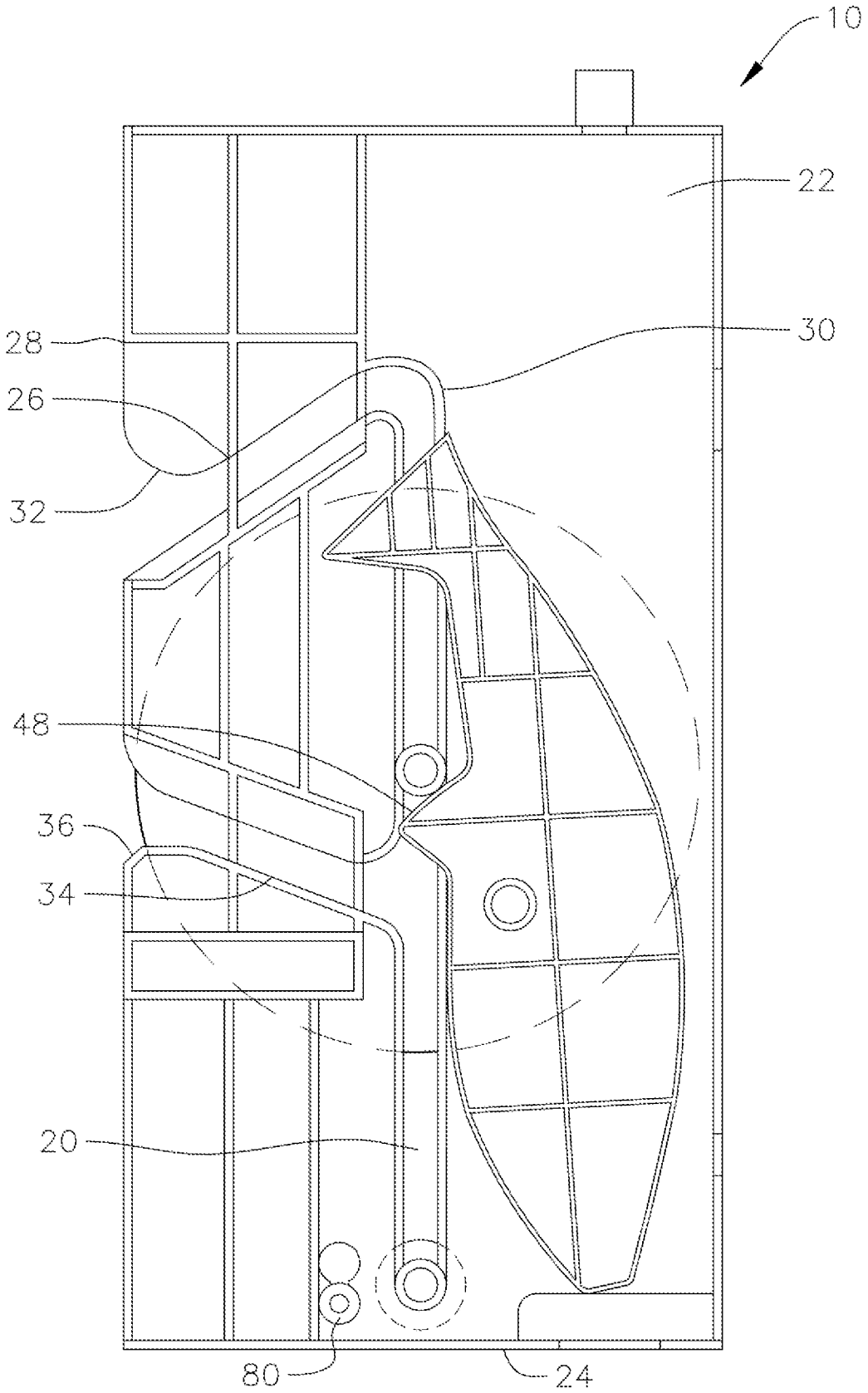
FIG. 3 a side view of the example embodiment dispenser shown in FIG. 2, with an upper roll moved to an upper dispensing position.

The paper on the first toilet paper roll 64 is dispensed by pulling from either the top of the roll or the bottom of the roll from the front of the dispenser. As paper is used and the roll outer diameter decreases and the first spindle 62 of the first toilet paper roll slides downward along the vertically extending slides. As the first spindle 62 slides downward along the vertically extending slots, it maintains contact with the second portion 54 of the front end of the cam and is subjected to a downward force by the cam as the cam rotates (clockwise in FIG. 4) when the second toilet paper roll is on the cam upper inclined end 44 due to the weight of the roll, and also due to its own weight, pivot point and geometry. As the cam rotates (clockwise in FIG. 2) the upper inclined end 44 of the cam moves away from the vertically extending slot while at least a portion of the projection 46 remains intercepting the vertically extending slot. When that occurs the second spindle 68 and thus the upper or second toilet paper roll 70 is released from the inclined upper end of the cam and slides down the vertically extending slots and rests against the intermediate projected end surface 48 causing the cam to rotate with its upper end rotating towards the front (counter-clockwise in FIG. 3), as for example shown in FIG. 3. The second spindle and thus the second toilet paper roll is now resting against the intermediate projected end surface 48 and in a second dispensing position and can be used by withdrawing paper from the front of the dispenser. The paper from the second roll can be withdrawn from the top or the bottom of the roll. This position of the second spindle and second toilet paper roll remains vertically stationary, unlike the first spindle and first paper roll that slide downward along the vertically extending slot when the first roll is being used.

Figure 6:
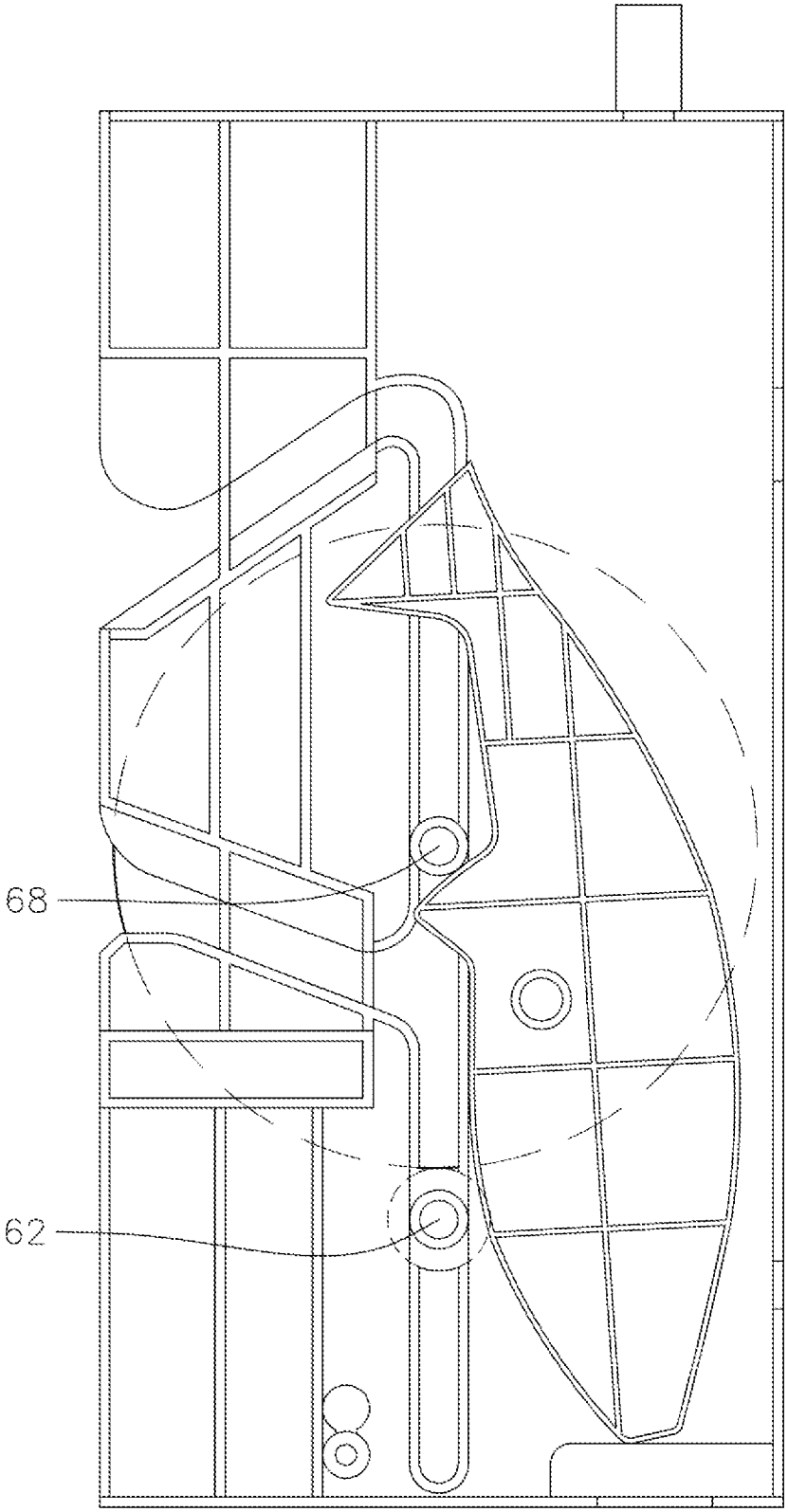
FIG. 6 is a side view of the example embodiment dispenser shown in FIG. 2, with a spindle of a lower roll moved for removing.

Once the first paper roll is used, the first spindle 62 may be removed by sliding upwards along the vertically extending slot, as for example shown in FIG. 6. When that occurs, the second roll (e.g., the second roll outer surface) is intercepted by the first spindle forcing the second roll upwards. When the first spindle comes in contact with front end 50 of the cam, the cam will rotate with the upper end of the cam rotating towards the rear end of the vertical wall such that the inclined end 44 moves away from the vertically extending slot. As such, as the lower spindle is further removed from the lower transverse slot through the front end of the right wall, the projection 46 withdraws away from the vertically extending slot and the second spindle with the second roll falls into the first dispensing position previously occupied by the first spindle and first roll, and the second roll may be dispensed from the first dispensing position. The cam will then rotate with its upper inclined end 44 towards the front and over in the vertically extending slot (counter-clockwise as shown in FIG. 2). A third roll may again be mounted with another spindle through the upper transverse slots and supported by the upper inclined ends 44 of the cams.

Figure 7:
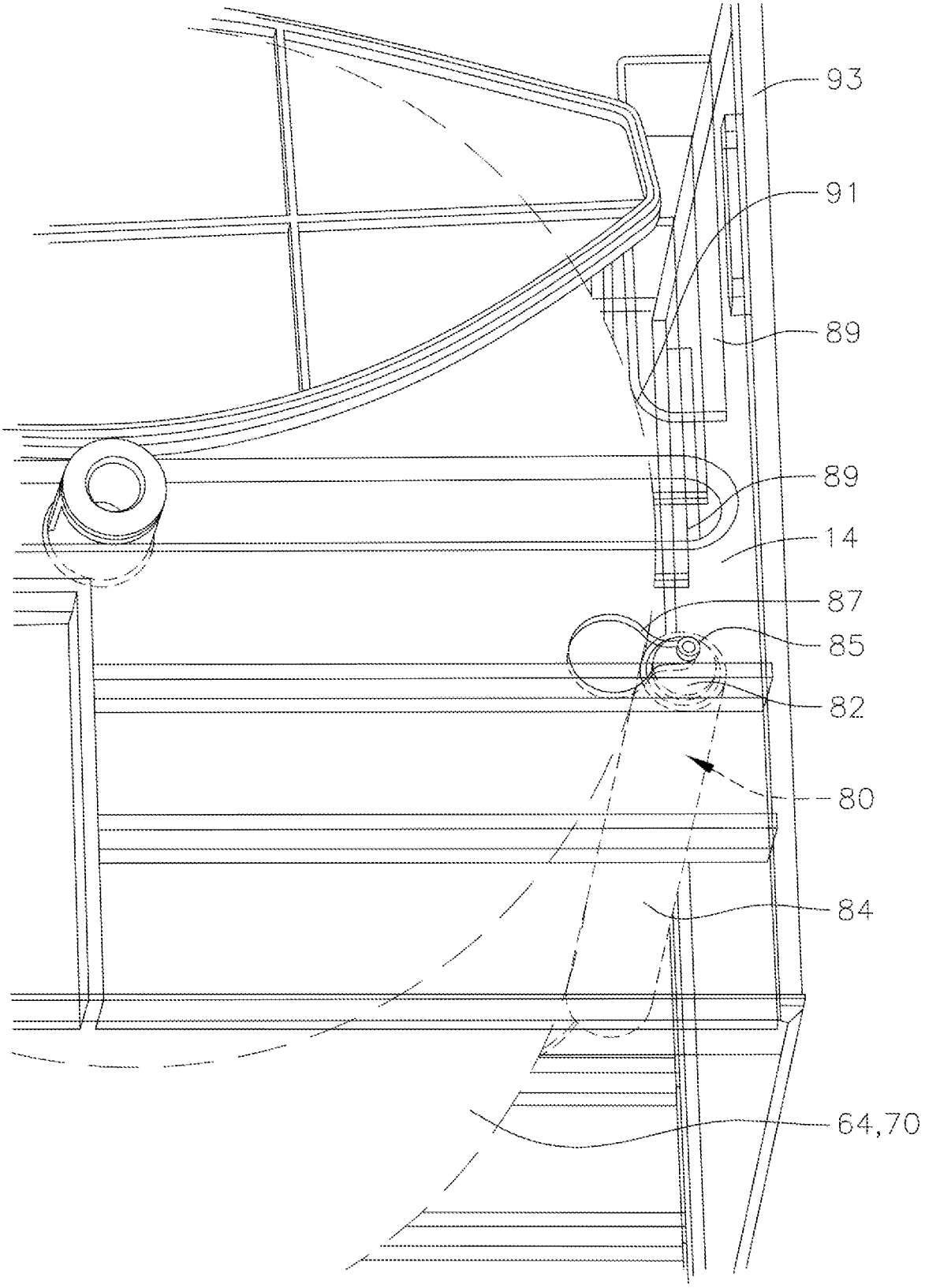
FIG. 7 is a partial bottom perspective view of the example embodiment dispenser shown in FIG. 2.

At the bottom of the housing may be positioned a lower transverse spindle 80 so as to help the toilet paper roll when in the first dispensing position rotate, as shown in FIG. 7. The lower transverse spindle may in an example embodiment have an inner member 82 that is connected at opposite ends to the left and right vertical walls, and a coaxial sleeve 84 rotating over the inner member. In an example embodiment, a pin 85 extends axially from each end of the inner member 82 and is fitted into a corresponding keyhole slot 87 in each vertical wall. In an example embodiment, the overall inner member 82 can rotate relative to the pins 85 so as to further reduce rotational friction of the coaxial sleeve. In operation, the outer surface of the first roll rests against the outer coaxial sleeve 84 of the lower transverse spindle. As paper is being pulled to be dispensed from the first roll, the coaxial outer sleeve rotates with the roll relative to the inner member to facilitate dispensing. If the roll was to touch the bottom of the dispenser directly, dispensing of paper may be prevented as the bottom of the dispenser may provide friction against the roll. Moreover, in an example embodiment, one or more ribs 89 extend from a base 93 or a rear of the dispenser. In an example embodiment, the ribs have round upper front end corners 91. These ribs, and in an example embodiment, the rounded corners, along with the lower transverse spindle support the lower roll to provide stability during dispensing. More specifically, the roll 64, 70 is supported axially along its bottom by the lower transverse spindle and the rounded corners of the ribs in a spaced apart relationship. This support is particularly effective when the lower roll has a core or opening for receiving the lower transverse spindle of a larger inner diameter than the outer surface diameter of the lower transverse spindle, as for example, when such core or opening has an inner diameter greater than twice the outer surface diameter of the lower transverse spindle sleeve.

Figure 8:
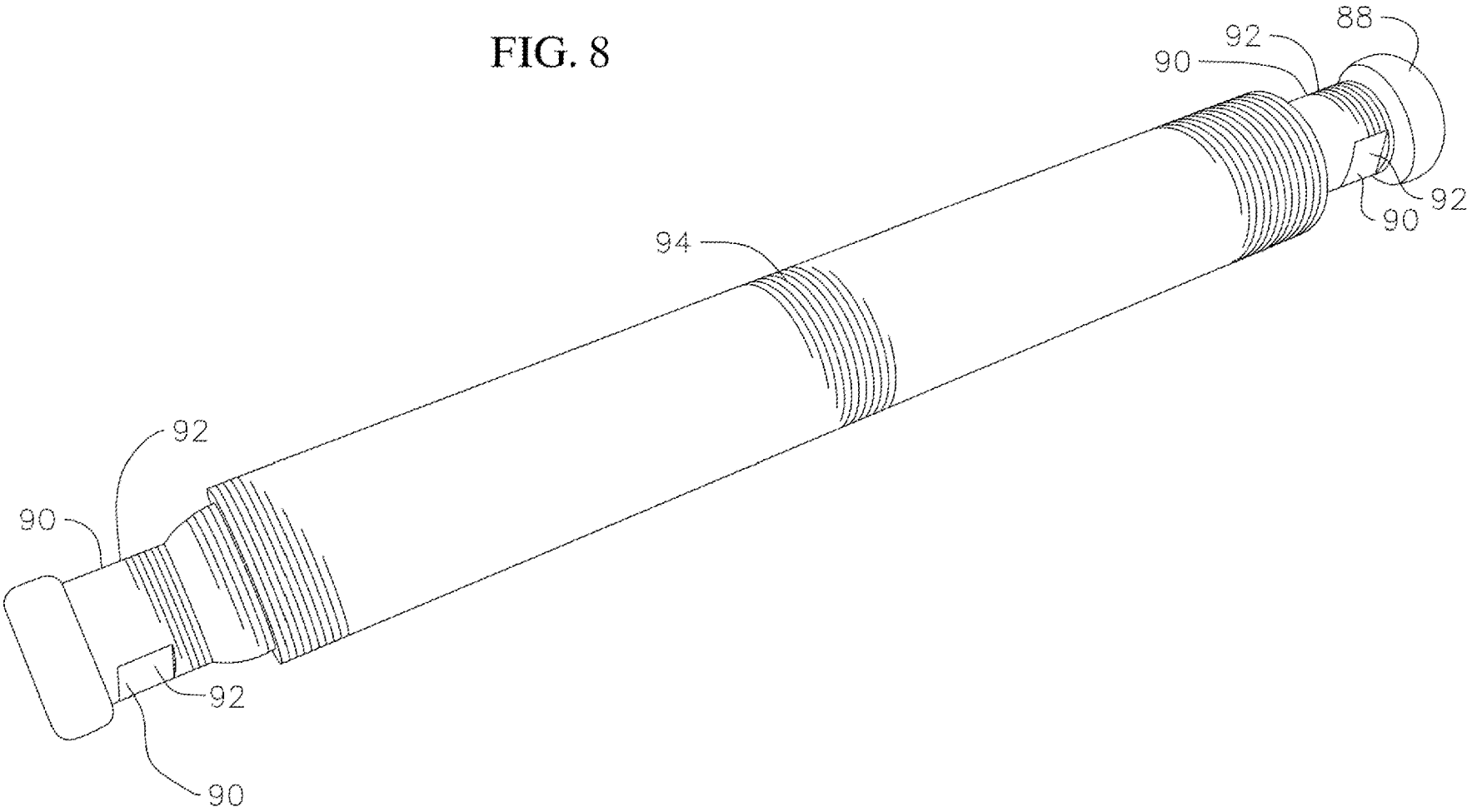
FIG. 8 is a perspective view of an example embodiment spindle for mounting rolls in an example embodiment roll sheet material dispenser.

In an example embodiment, the toilet paper spindles 62, 68 have an inner member 88 having opposite flat sections 90 at their opposite end portions defining opposite grooves 92, as for example shown in FIG. 8. When slid in the slots (e.g. the upper transverse, lower transverse, or vertically extending slots, opposite edges of the slots are received in the opposite grooves 92, and prevent the inner member from rotating relative to the slots. The toilet paper spindles also have corresponding coaxial outer sleeves 94 over their inner members that rotate relative to their inner members. The coaxial outer sleeves 94 assist with the dispensing of toilet paper as they roll with the toilet paper due to the contact of the sleeves with the toilet paper rolls or the toilet paper when no roll is used.

In an example embodiment, a sheet of material may be dispensed from a first roll with its spindle located at a first location (i.e., a first dispensing position). As the sheet of material is being dispensed from the first roll, the outer diameter of the roll decreases and thus, the roll is simultaneously lowered. When lowered to a predetermined level, a second roll of material is lowered to a second location (i.e., its spindle is at a second dispensing location) above the first location from a third location above the second location. When at the second location, the roll is at the second dispensing location. A sheet of material may then be dispensed from the second roll. The first roll may be mounted on a first spindle and the second roll may be mounted on a second spindle. When the second roll is in the second location, removal of the first spindle causes the second spindle and thus the second roll to move to a location below the second location where dispensing of said sheet of material from the second roll can occur. A third roll may then be mounted with its spindle at the third location. When at the third location a roll is at the third dispensing position or the reserve position.

In an example embodiment, the second dispensing position is fixed at a desired height in that the spindle does not slide downward as the roll is dispensed and its outer diameter is decreased. In addition, when a roll drops from the reserve position to the second dispensing position it does not touch the roll in the first dispensing position. In an example embodiment, the cams do not allow for rolls to be simultaneously in the reserve and second dispensing positions. Moreover, in an example embodiment, when the dispenser is loaded with unused rolls, a first roll will be in the first dispensing position while the second roll will be in the reserve position.

While the method of operation in the illustrated embodiments was described for a device that uses cams, it should be understood that in other example embodiments, instead of cams electrically operated latches or other mechanisms along with sensors may be used to hold the rolls of sheet material and to dispense the sheet of material from the various rolls as described herein. The sensor may be used for example, to sense how much sheet material is left on the first roll before allowing the second roll to move to the second position.

In other example embodiments, instead of the two cams being mirror images of each other, they may have different geometries that provide the same function.

While the present disclosure has been described with respect to a limited number of embodiments, those skilled in the art, having benefit of this disclosure, will appreciate that other embodiments and modifications can be devised which do not materially depart from the scope of the invention as disclosed herein. All such embodiments and modifications are intended to be included within the scope of this disclosure as defined in the following claims.

What is claimed is:

1. A method of dispensing sheet material from two rolls comprising:

dispensing a first sheet of material from a first roll of said sheet of material located at a first location while supporting a second roll of sheet material on a portion of a cam;

lowering said first roll from said first location as the first sheet of material is being dispensed;

lowering the second roll of sheet material onto a second location above the first location when the first roll has been lowered to a location below the first location;

supporting said second roll at said second position by another portion of said cam; and dispensing a second sheet of material from said second roll, wherein the first roll is mounted on a first spindle and the second roll is mounted on a second spindle, wherein lowering said first roll comprises lowering said first spindle, wherein when at the first location, the first spindle is at a first spindle location, and wherein when at a second location, the second spindle is at a second spindle location, the method further comprising maintaining said second spindle at said second spindle location during dispensing of said second sheet of material.

2. The method of claim 1, wherein prior to lowering the second roll of material onto the second location, the method further comprises placing said second roll of material at a third location above the second location.

3. The method of claim 1, further comprising:

removing the first spindle; and lowering the second spindle to a location below the second spindle location.

4. The method of claim 3, further comprising placing a third roll of sheet material at a third location above the second location.

5. A dispenser comprising:

a first wall having a forward end;

a second wall opposite and spaced apart from the first wall, said second wall having a forward end, wherein each of the first and second walls comprise, a vertically extending slot;

a first slot extending transversely from the vertically extending slot to the forward end;

a second slot extending transversely from the vertically extending slot to the forward end, wherein the second slot is below the first slot; and a pivotably coupled cam for pivoting along a plane parallel to the wall of said first and second walls to which it is pivotably coupled comprising, a first end, a projection below the cam first end, wherein the cam pivots from a first position where the first end and the projection intersects the vertically extending slot to a second position where the first end does not intersect the vertically extending slot and the projection intersects the vertically extending slot for retaining a spindle within said vertically extending slot above said projection.

6. The dispenser of claim 5, further comprising at least another spindle coupled to the first and second walls proximate a lower end thereof.

7. The dispenser of claim 5, further comprising at least another spindle in at least one of said slots on both said first and second walls, wherein one of said spindle or at least another spindle comprises an inner member and a sleeve coaxially over the inner member and rotatable relative to the inner member.

8. The dispenser as recited in claim 7, wherein the inner member comprises opposite grooves proximate either end thereof, and wherein edges of said slots are received in each of said grooves.

9. The dispenser as recited in claim 7 wherein one of said spindle and said at least another spindle penetrates a roll of material.

10. The dispenser as recited in claim 9, wherein the roll of material comprises a core.

11. The dispenser as recited in claim 9, wherein the roll of does not include a core.

12. The dispenser as recited in claim 9, wherein the roll of material is a toilet tissue roll of material.

13. The dispenser as recited in claim 12, wherein the roll of material comprises a core.

14. The dispenser as recited in claim 12, wherein the roll of material does not include a core.

15. The dispenser as recited in claim 5 further comprising at least a spindle in at least one of said slots on both said first and second walls, wherein said spindle penetrates a roll of material.

16. The dispenser as recited in claim 15, wherein the roll of material is a toilet tissue roll of material.

17. The dispenser as recited in claim 5, further comprising a third wall interconnecting the first and second walls.

18. The dispenser as recited in claim 5, wherein the first end of each of said first and second slots is configured for supporting a roll of material, and wherein the projection of each of said first and second slots is configured for supporting a roll of material.

19. The dispenser as recited in claim 5, further comprising at least another spindle in at least one of said slots on each of said first and second walls, wherein one of said at least another spindle penetrates a roll of material.

* * * * *